US005931203A

United States Patent [19]

Kredler et al.

[11] Patent Number: 5,931,203

[45] Date of Patent: Aug. 3, 1999

[54] PROCESS FOR PRODUCING TWISTED, PREPARED LINES AND A DEVICE FOR EXECUTING THE PROCESS

[75] Inventors: Gerhard Kredler, Vilseck; Josef Konrad, Etzenricht, both of Germany

[73] Assignee: Baumann GmbH, Germany

[21] Appl. No.: 08/961,777

[22] Filed: Oct. 31, 1997

[30] Foreign Application Priority Data

| | | | |
|---|---|---|---|
| Nov. 20, 1996 | [DE] | Germany | 196 47 895 |
| Nov. 30, 1996 | [DE] | Germany | 196 49 759 |
| Aug. 15, 1997 | [DE] | Germany | 197 35 655 |

[51] Int. Cl.[6] ..... B21F 7/00

[52] U.S. Cl. ..... 140/149

[58] Field of Search ..... 140/115, 149

[56] References Cited

U.S. PATENT DOCUMENTS

| | | | |
|---|---|---|---|
| 1,716,844 | 6/1929 | Van Veen | 140/149 |
| 2,835,283 | 5/1958 | Thone . | |
| 3,750,720 | 8/1973 | Steigerwald . | |
| 4,194,281 | 3/1980 | Gudmestad | 140/149 |
| 5,052,450 | 10/1991 | Williams | 140/149 |

FOREIGN PATENT DOCUMENTS

| | | |
|---|---|---|
| 23 13 417 | 10/1973 | Germany . |

*Primary Examiner*—Lowell A. Larson
*Attorney, Agent, or Firm*—Hoffman, Wasson & Gitler

[57] ABSTRACT

The invention relates to a novel process for producing twisted prepared lines, in which process at least two individual lines after their preparation are then twisted in a twisting device with clamping between two holders between which a twisting segment is formed and of which one can be moved along this twisting segment, by turning at least one holder, and to a novel device for executing the process.

9 Claims, 10 Drawing Sheets

PROCESS FOR PRODUCING TWISTED, PREPARED LINES AND A DEVICE FOR EXECUTING THE PROCESS

FIELD OF THE INVENTION

The invention relates to a process for producing twisted prepared lines, in which at least two individual lines, after their preparation, are then twisted in a twisting device while clamped between two holders, between which a twisting segment is formed, and of which one can be moved along this twisting segment by turning at least one holder. The invention also pertains to a device for performing the process, with a preferably horizontal carriage guide provided on a device frame for a carriage, with a first holder located on the carriage, with a second holder provided in the area of one end of the carriage guide on the frame. Between the two holders a twisting segment is formed and one holder can be driven to rotate around the axis of the twisting segment by a drive.

BACKGROUND OF THE INVENTION

In many technical areas, especially also for satisfying existing regulations relating to the avoidance of electrical, magnetic or electromagnetic interference fields, twisted, also prepared lines are necessary, for example, for producing cable harnesses, for example, for motor vehicle manufacture.

"Prepared individual lines" for the purposes of the invention are individual lines which have an electrical conductor in the form of a metal wire or a flexible metal lead and which are cut to a given length. The prepared individual lines can then for example also be provided on at least one end with an electrical connection element, for example with a plug-like or socket-like connection element. Twisted prepared lines for the purposes of the invention then consist of at least two prepared individual lines which are twisted with one another.

Relatively high demands are imposed on the production of twisted, prepared lines with respect to adherence to tolerances. Thus, for example, at a total length of a twisted prepared line between 250 to 6500 mm the length tolerance is ±15 mm, the length of lay is from 13 to 50 mm at lay tolerances of 0/+3 mm (length of lay less than 35 mm) or 0/+5 mm (length of lay greater than 35 mm). Furthermore, the end offset, i.e., the offset between the ends of the individual lines provided on the respective end of the twisted line, should not exceed 10 mm, for example.

A process is known in which the individual lines when twisted on one end are clamped on a first holder and are pulled through by a second rotating holder (by continuously moving the first clamping holder away from the second clamping holder) and in doing so twisted. This known process, in spite of a complex twisting device, does not lead to the desired results.

SUMMARY OF THE INVENTION

The object of the invention is to devise a simplified process. To do this a process is provided in which prepared individual lines are first clamped on both ends with their entire length between the holders of the twisting segment which are formed by clamping devices, and that twisting takes place by turning at least one holder while maintaining a stipulated tension of individual lines. A device is provided having a control means with which clamping devices, drive for rotary clamping device and carriage drive can be controlled such that before the start of each twisting process individual lines are tensioned first with their entire length between two clamping devices on the twisting segment and then individual lines, tensioned over their entire length, are twisted by corresponding braking of the carriage to maintain a stipulated or preselected tension by turning of the clamping device provided on carriage.

The invention allows simple production of twisted prepared lines with high precision. Furthermore the invention, also with high precision and quality, allows twisting of individual lines which have a different cross section, preferably also a different cable cross section.

DETAILED DESCRIPTION OF THE DRAWINGS

The invention is detailed in the following using figures on embodiments.

Figure 3:
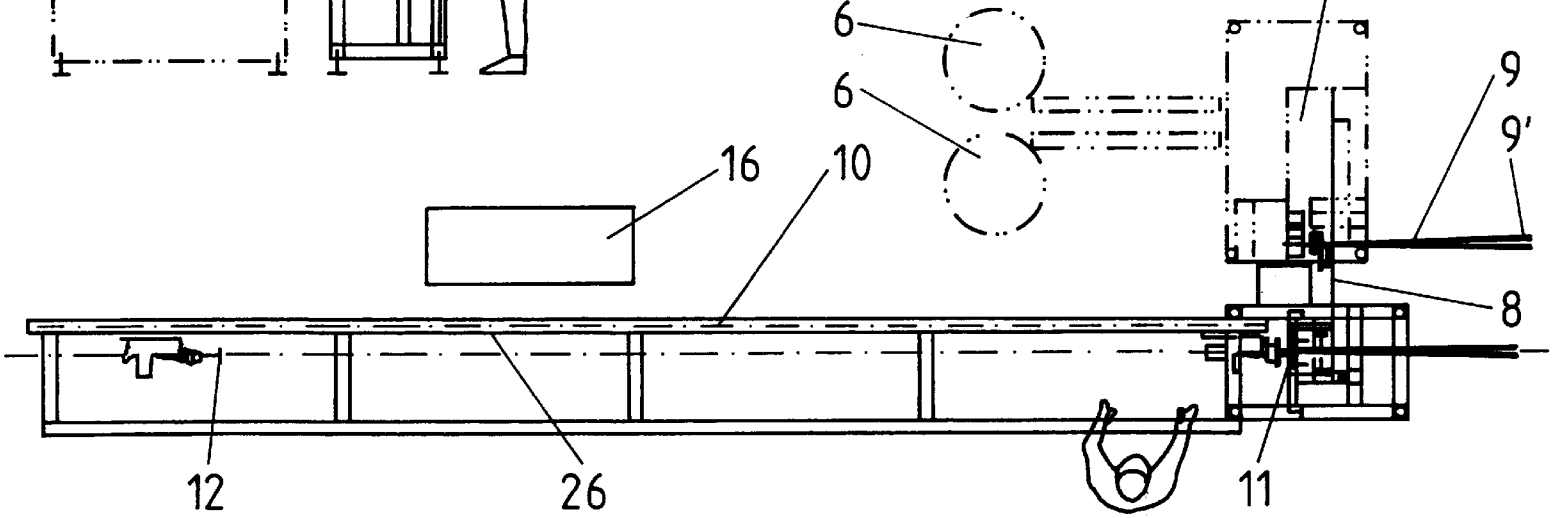
FIG. 3 shows an overhead view of the device of FIG. 1.
Figure 4:
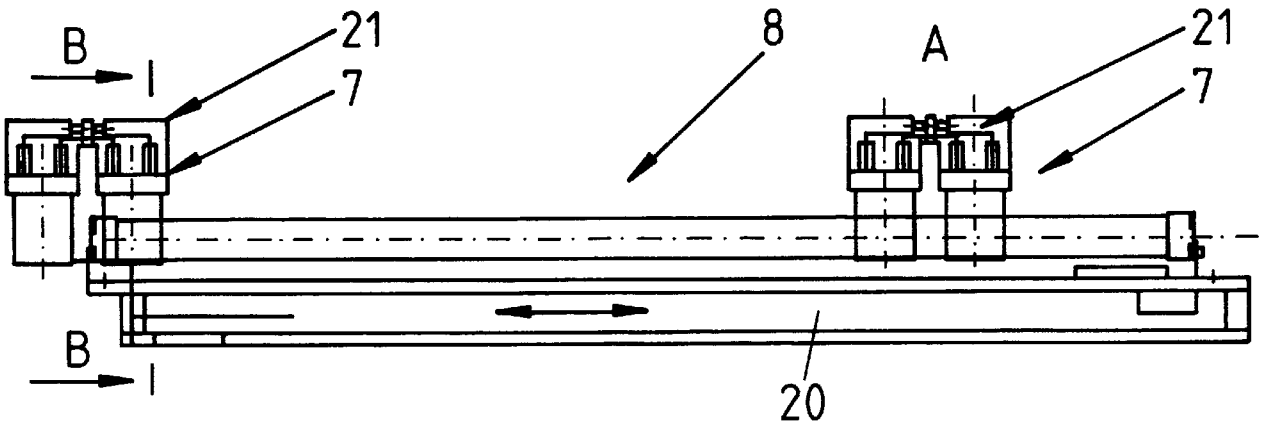
FIG. 4 shows in an individual view and in a side view a transfer carriage for transferring the lines provided with an electrical coupling from a preparation machine to the twisting device.
Figure 6:
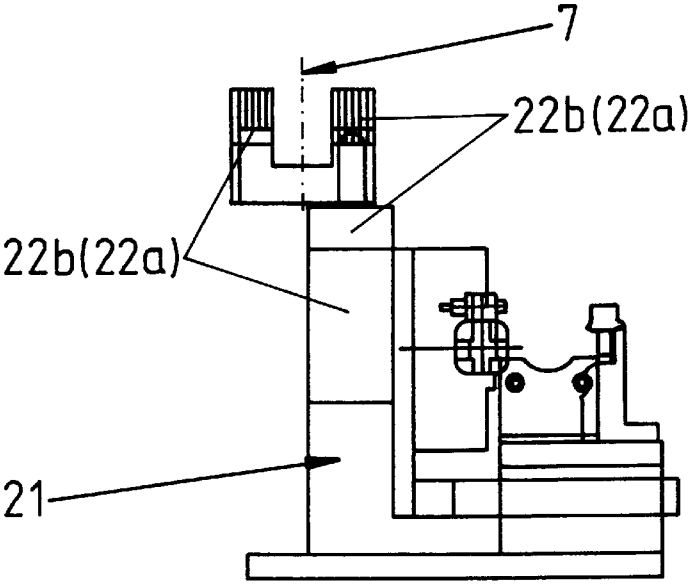
Figure 5:
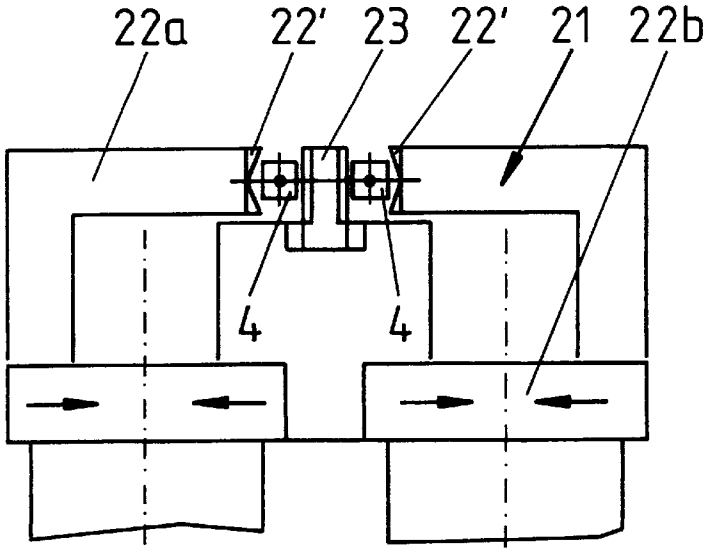
Figure 7:
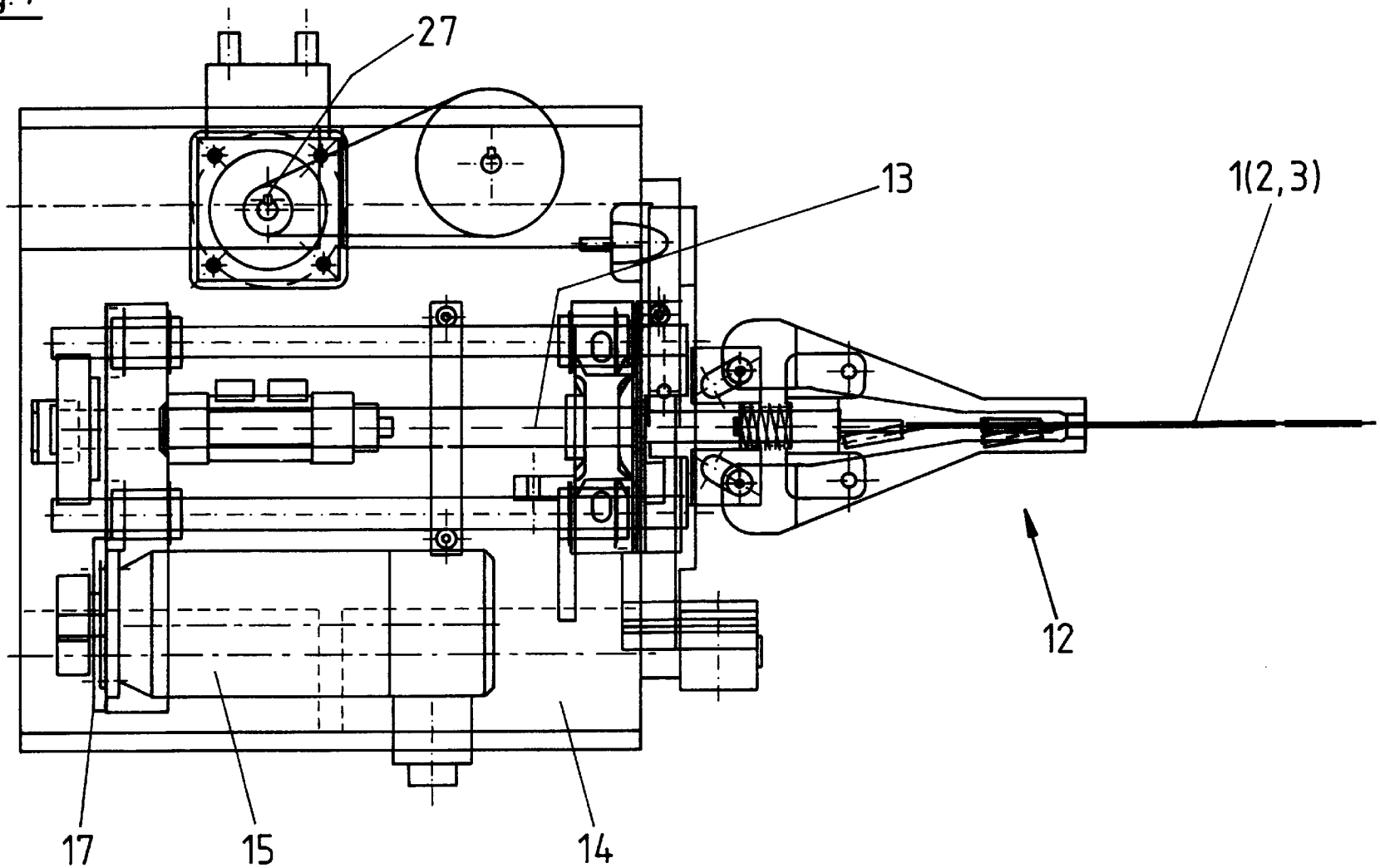
Figure 8:
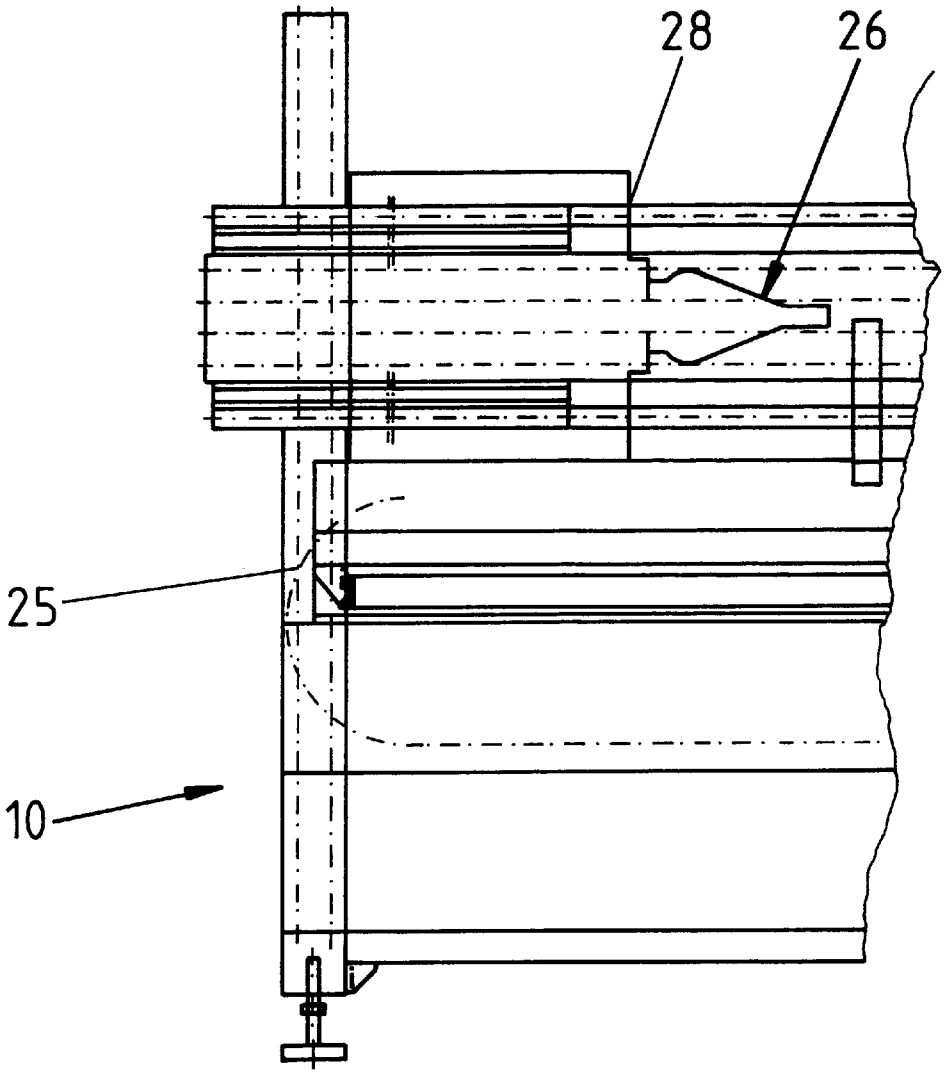
Figure 9:
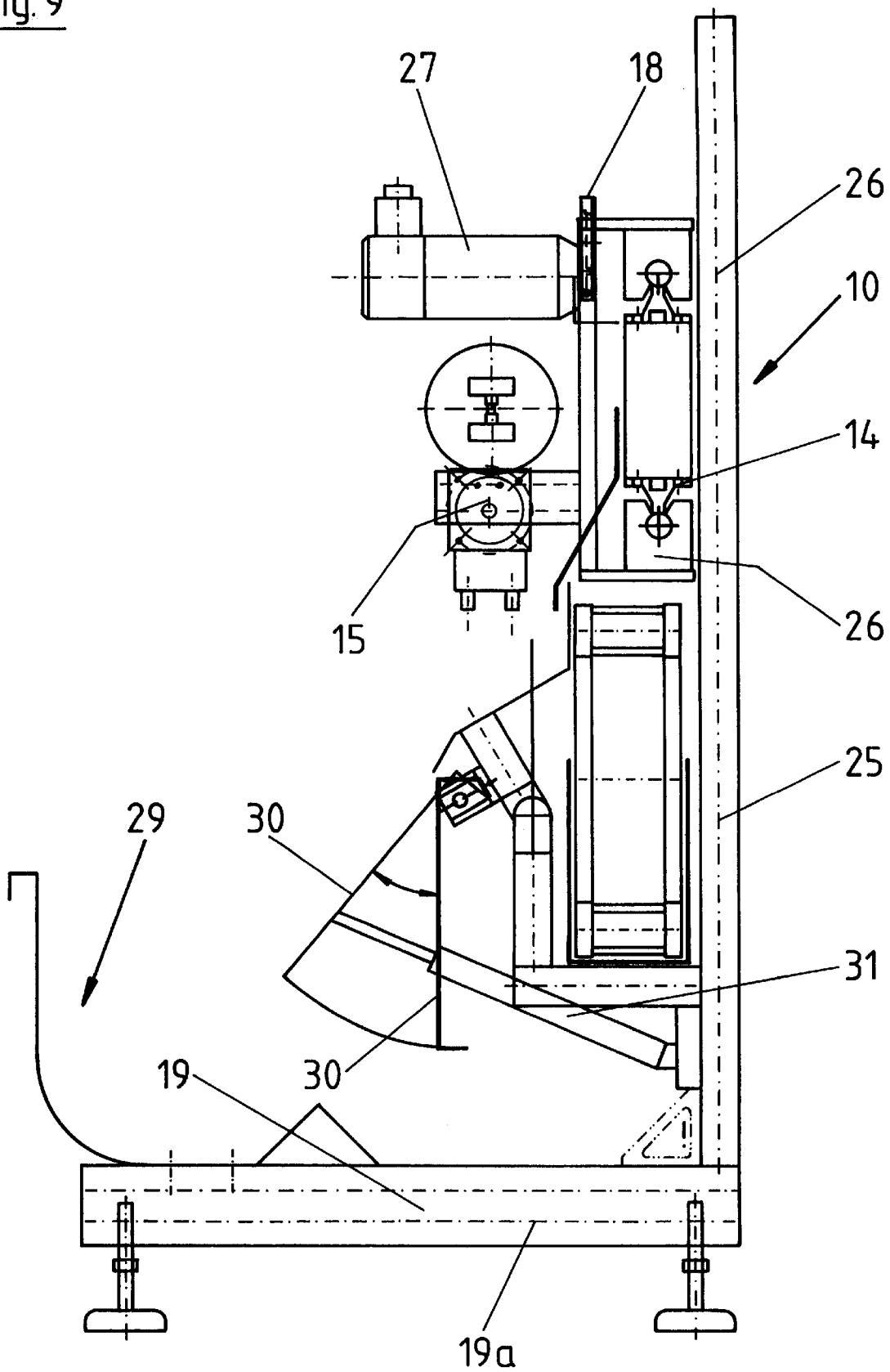
Figure 10:
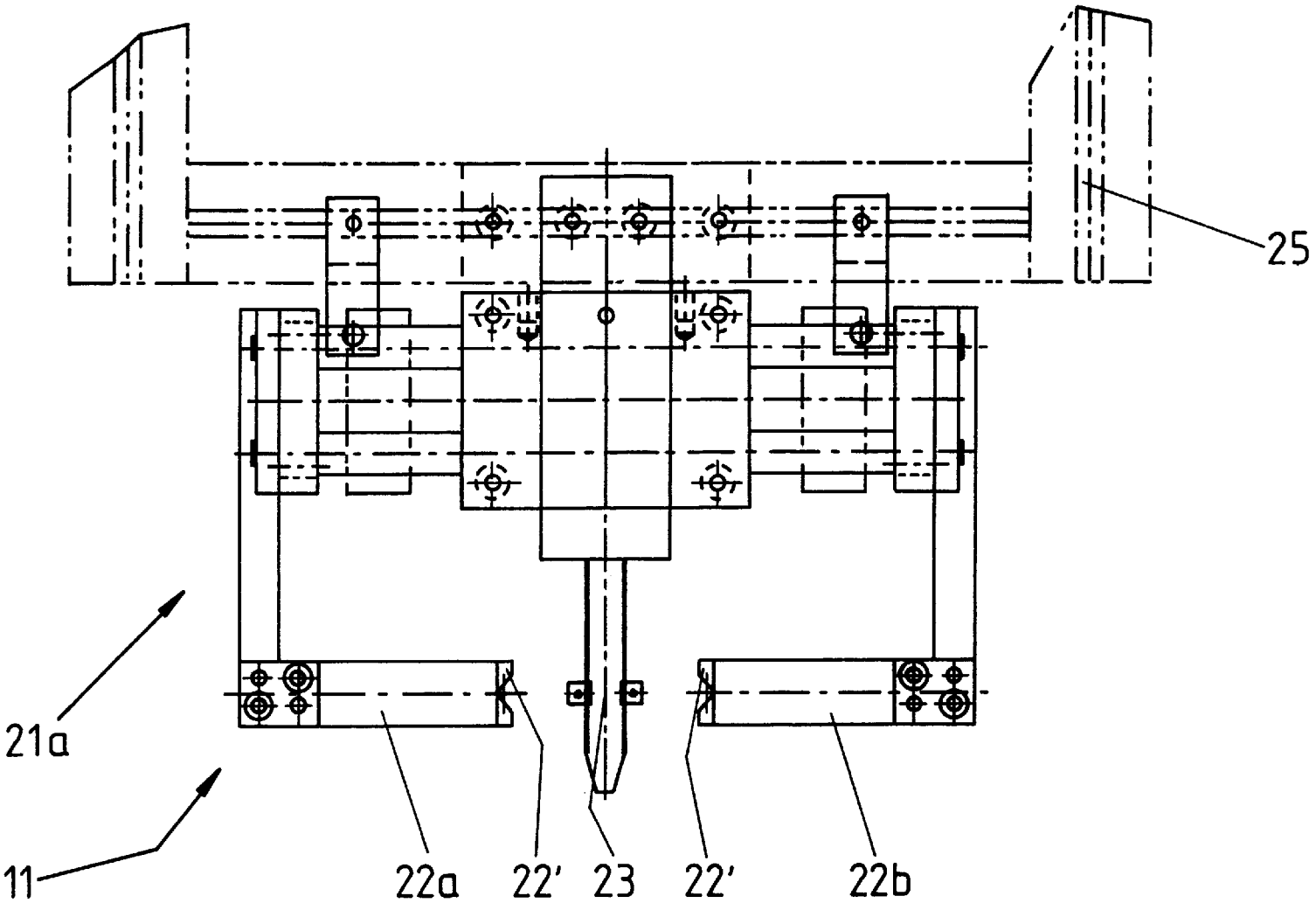
Figure 11:
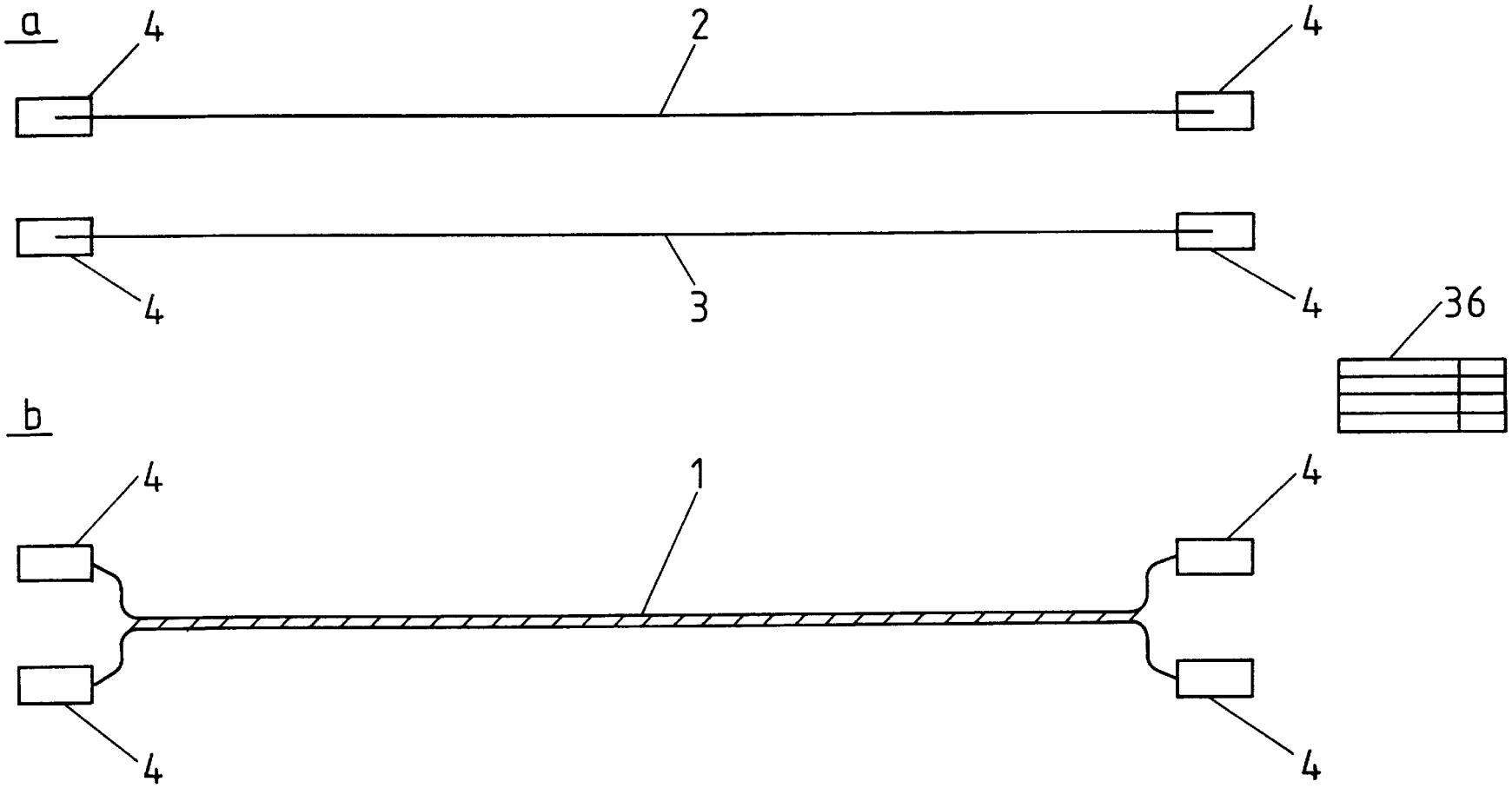
Figure 12:
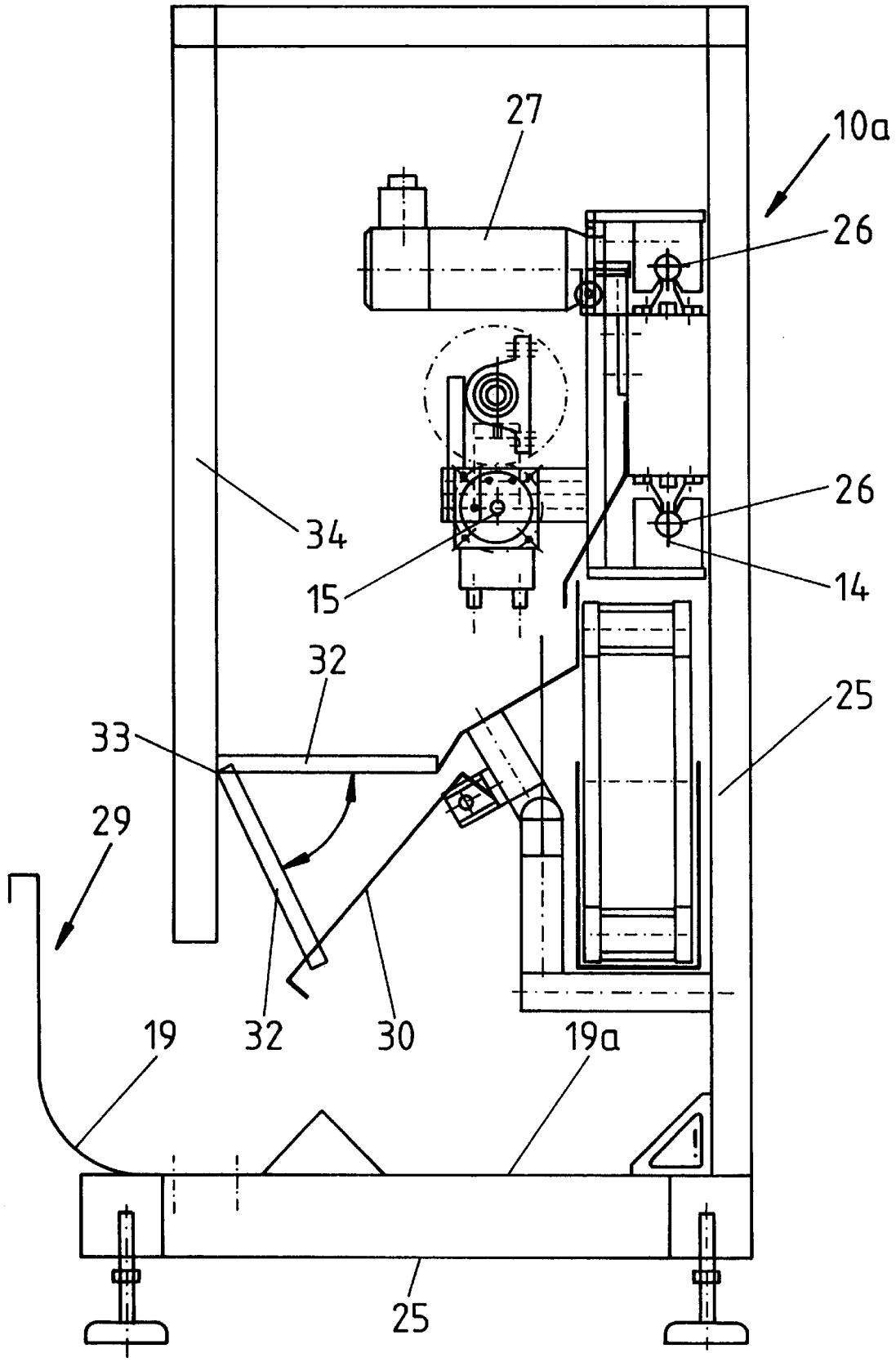
Figure 13:
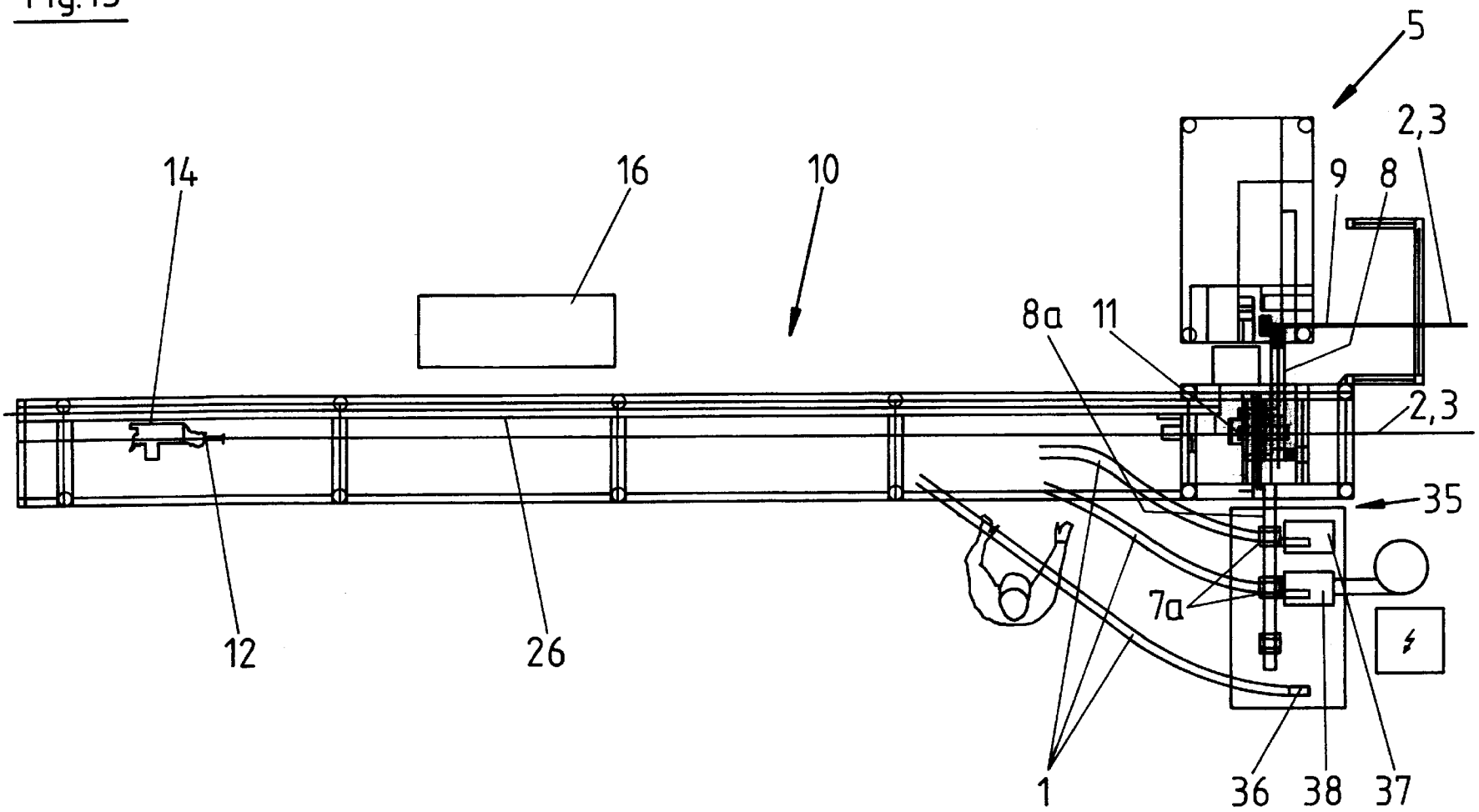
Figure 14:
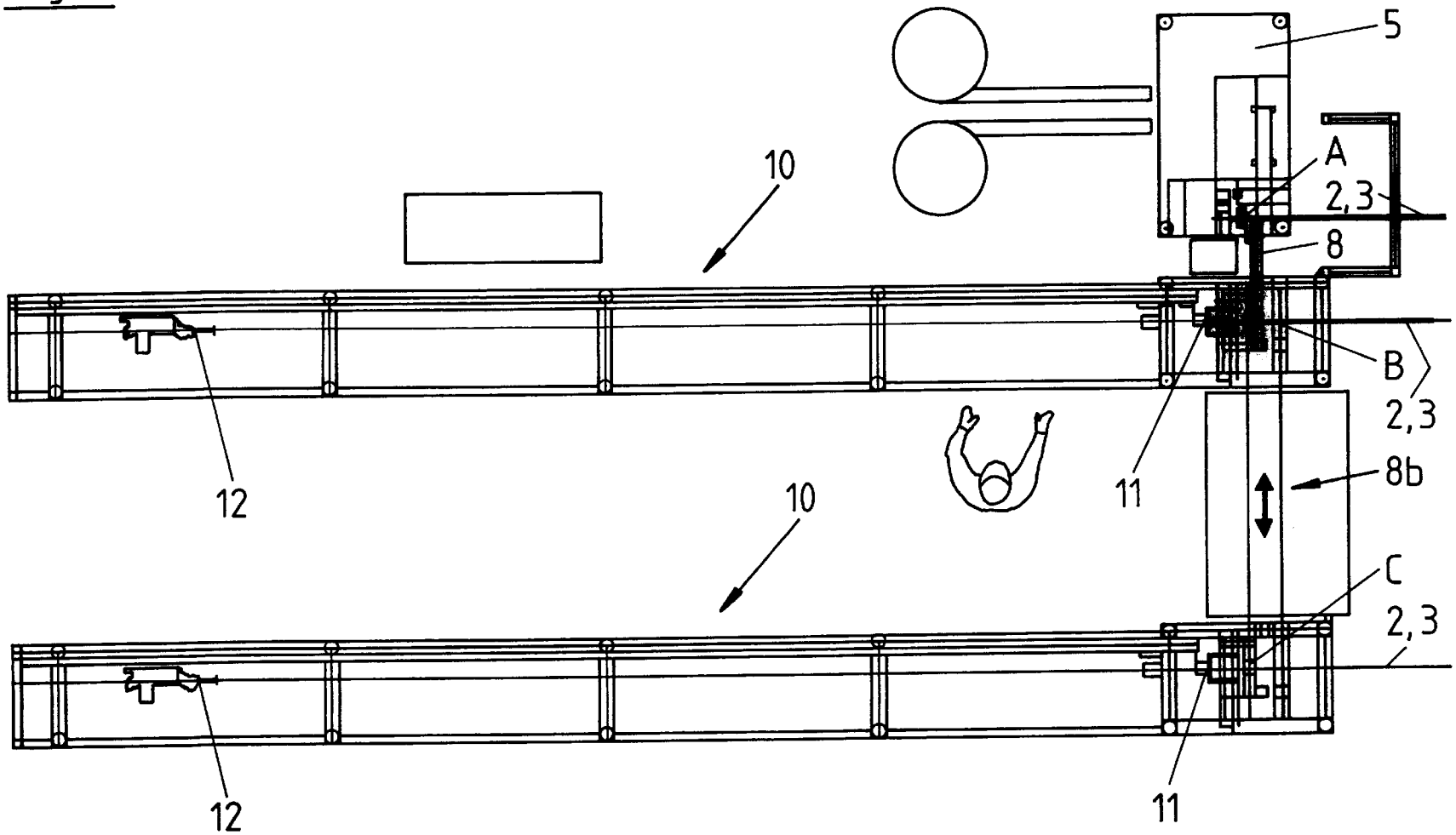

FIG. 5 in an enlarged detailed representation and in a side view shows a gripper head of the transfer means with the transfer carriage;

FIG. 6 shows a cross section according to line I—I of FIG. 4;

FIG. 7 shows in an enlarged individual representation and in a side view a carriage of the twisting device, together with a partial length of the carriage guide;

FIG. 8 shows in a simplified representation and in a side view the horizontal carriage guide;

FIG. 9 shows a cross section through the twisting device;

FIG. 10 shows a clamp head or holding head of the twisting device;

FIG. 11 shows positions a and b two electrical lines after preparation (position a) and after twisting (position b) [sic];

FIG. 12 shows a representation like FIG. 9 in another possible embodiment; and FIGS. 13 and 14 show other possible embodiments in an overhead view or in a representation similar to FIG. 3.

DETAILED DESCRIPTION OF THE PREFERRED EMBODIMENT

Figure 1:
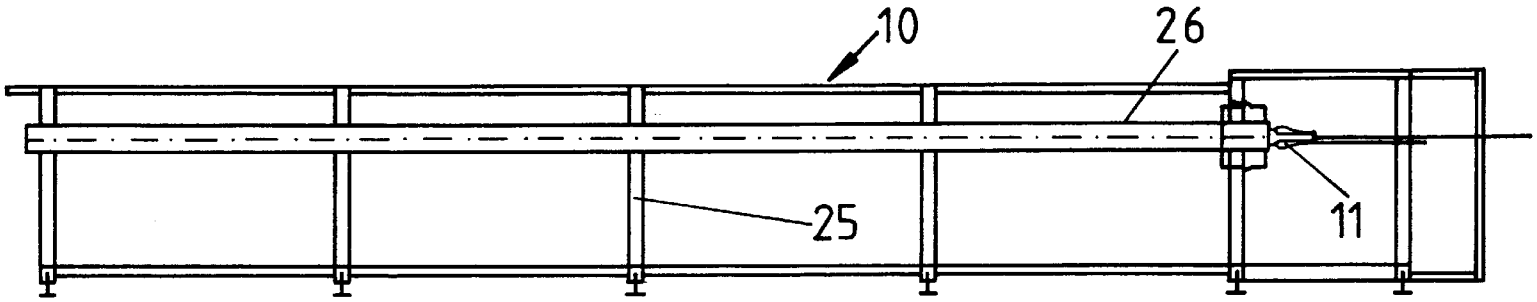
FIG. 1 shows one embodiment of the device of the invention in a side view.
Figure 2:
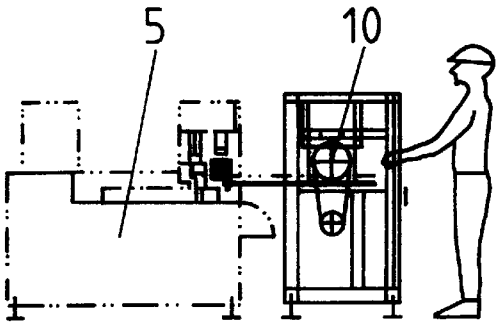
FIG. 2 shows the device of FIG. 1 in a side view according to arrow A of FIG. 1.

The overall system shown in FIGS. 1–3 is used to produce prepared, twisted lines 1 which are formed in the embodiment shown by two individual lines 2 and 3 as shown in FIG. 11. Each individual line consists conventionally of one, for example, flexible lead-like conductor with electrical insulation which surrounds one of these conductors and is provided on each end with electrical coupling 4, for example, plug-like or socket-like coupling piece 4. Two individual lines 2 and 3 are withdrawn from a supply (supply spool 6) provided there in preparation machine 5 shown in FIGS. 2 and 3 and are each cut to the required stipulated length. In this preparation individual lines 2 and 3 are at the same time provided with couplings 4 on each end. Preparation machines 5 for this purpose are known to one skilled in the art. The individual lines are prepared in preparation machine 5 in pairs, i.e., after each working cycle of preparation machine 5 two completely prepared individual lines 2 and 3 are available lying next to one another.

Prepared individual lines 2 and 3, each held in the area of the trailing end when removed from storage spool 6, i.e., held in the area of coupling piece 4, are transferred to transfer carriage 7 of transfer means 8 shown in FIG. 4, so that prepared individual lines 2 and 3 stand apart above the side of preparation device 5 facing away from storage spools 6, as is reproduced in FIG. 3 with item 9. Using transfer means 8 two individual lines 2 and 3 are moved to twisting device 10 in which two individual lines 2 and 3 are twisted into twisted, prepared line 1 (item b of FIG. 11).

One particular feature consists in that the twisting of individual lines 2 and 3 takes place such that the two lines with their two ends and with their entire length are held under tension between stationary holder 11 and holding tongs 12 of twisting device 10, and each individual line 2 and 3 with one end in holder 11 and with the other end in holding tongs 12. Holding tongs 12 are located on spindle 13 which is axially identical to the axis of tensioned individual lines 2 and 3 or the twisting segment between holders 11 and 12 and is supported to turn on carriage 14 of twisting device 10. Spindle 13 is rotary-driven by electric motor 15 on carriage 14 so that when spindle 13 turns twisting of individual lines 2 and 3 takes place, the individual lines being freely tensioned over their entire length and twisting taking place only from one end of these individual lines.

When individual lines 2 and 3 are twisted, a certain shortening of the actual length of these lines or of the distance between holders 11 and 12 takes place; this is equalized by moving carriage 14 in the direction of holder 11. A braking means provides for a sufficiently high tension being maintained on two individual lines 2 and 3 during the twisting process.

It has been found that individual lines 2 and 3, which are freely clamped over their entire length when twisting between holder 11 and holding tongs 12, are twisted, the twisting is very uniform. By means of sensor 17 (incremental encoder) integrated or provided on spindle 13 or electric motor 15 for this spindle, the number of revolutions of spindle 13 is measured and supplied to control means 16 as a measurement signal. At the same time a signal which defines the position of carriage 14 is supplied via second sensor 18 to control means 16. The length of the overlay (overlay length) attained during twisting can be determined from the rpm of spindle 13 in the twisting process and from the total length of individual lines 2 and 3 before twisting. If the required overlay length is achieved, and prepared twisted line 1 has a length which corresponds to the stipulated length or which lies within a stipulated tolerance range, which is ascertained based on sensor 18 which acquires the position of carriage 14, the prepared and twisted line 1 is placed in tray 19 provided for removal of the finished product with release by holder 11 and holding tongs 12. The components necessary for the mode of operation described very generally above are made as follows:

Transfer Means 8

Transfer means 8 consists essentially of aforementioned transfer carriage 7 which can be moved back and forth on horizontal rail or guide 20 in the horizontal direction by a linear drive which is not shown, between first position A for holding prepared individual lines 2 and 3 on preparation device 5 and second position B which is located underneath holder 11.

Referring to FIG. 5, on transfer carriage 7 are double holding tongs 21 which have two tong elements 22*a* and 22*b* which can be moved in opposite directions, and counterpiece 23 which is provided in the middle of these tong elements. Two tong elements 22*a* and 22*b* can be moved in one axial direction parallel to the axis of guide 20, i.e., in the horizontal direction for closing of the tongs toward counterpiece 23 and for opening of tongs 21 away from this counterpiece 23. Furthermore, tong elements 22*a* and 22*b* and also counterpiece 23 in holding tongs 21 are paired, and two counterpieces 23 in one horizontal axial direction are offset perpendicular to the longitudinal extension of guide 20 in succession and on either side of each counterpiece 23 there are two tong elements 22*a* and 22*b*. Tong elements 22*a* and 22*b* on each side of two counterpieces 23 are each activated by a common drive, for example, by a pneumatic cylinder. Tong elements 22 are shaped concavely on their tong surfaces 22' facing counterpiece 23 such that with these tong surfaces 22' coupling pieces 4 can be clamped securely, but not individual lines 2 and 3. Rather when tongs 21 are closed the tong elements with their surfaces 22' and counterpiece 23 each form an eye through which one individual wire 2 or 3 can by drawn in the longitudinal direction.

Holding tongs 21 are also guided in transfer carriage 7 such that they can execute a vertical stroke, i.e, a stroke perpendicular to the longitudinal extension of guide 20 by a stipulated amount by a drive, for example, a pneumatic drive. Because tong elements 22*a* and 22*b* and counterpiece 23 are each doubled, between these tong elements and counterpieces 23 gap 24 is formed which is open to the top.

Twisting Device 10

Twisting device 10 comprises horizontal carriage guide 26 which is formed on device frame 25 and on which carriage 14 is guided in the horizontal axial direction perpendicular to the longitudinal extension of guide 20 or transfer means 8.

On one end of carriage guide 26, on frame 25 is holder 11, shown in FIG. 1, which is made as holding tongs 21*a* which differ from holding tongs 21 essentially only in that two tong elements 22*a* and 22*b* are each provided only once with pertinent counterpiece 23. The arrangement of holder 11 is furthermore such that when transfer carriage 7 is in the second position holding tongs 21 are held in the vertical direction under holder 11 and raised holding tongs 21 hold holding tongs 21*a* in gap 24. This makes it possible to transfer the ends of individual lines 2 and 3 clamped in closed holding tongs 21 on couplings 4 to holder 11 or holding tongs 21*a* by moving closed holding tongs 21 which hold individual lines 2 and 3 on one end or on couplings 4 there in the vertical direction to the top to holding tongs 21*a*. Holding tongs 21*a* are then closed so that the ends or couplings 4 are also held in holding tongs 21*a*, whereupon then holding tongs 21 are opened, lowered and moved back to position A. By means of holding tongs 12 on carriage 4 which has been moved to holder 11 the ends or couplings of individual lines 2 and 3 can be grasped by holding tongs 12. By slightly opening holding tongs 21*a* and then re-closing them, by moving carriage 14 away from holder 10 then individual lines 2 and 3 can be drawn through two eyes formed by counterpiece 23 and tong surfaces 22' of closed tongs 21*a* until finally the other trailing ends or couplings 4 there of individual lines 2 and 3 are held on holder 11.

For movement, carriage 14 has second electric motor 27 which drives gear 29 which interacts with rack 28 of carriage guide 26. This slip-free drive makes it possible for example to use the incremental encoder provided on motor 27 as sensor 18 for the position of carriage 14. Electric motor 27 is used at the same time as the carriage brake during twisting.

To twist individual wires 2 and 3 they are therefore first grasped on one end by holding tongs 12 when carriage 14 is on holder 11 and then drawn through the eyes formed by holder 11 by carriage 14 which is moving away from holder 11 until the other ends of the individual lines are held on holder 11. Then the above described twisting takes place.

Underneath carriage guide 26, on frame 25 is tank 29 which is open to the top and which forms with its front area tray 19 for satisfactorily twisted, prepared lines 1 and farther below, tray 19*a* for those lines 1 which are not within stipulated tolerances. Above tank 29 is swivelling slide 30 which can be moved or swivelled by hydraulic cylinders 31 between two positions such that in one upper position of slide 30 the free lower end of this slide ends above tray 19 and in the other position of the slide above tray 19*a*, so that depending on the position of slide 30 twisted lines 1 after their release are sorted into trays 19 or 19*a* on holder 11 and holding tongs 12. Like tank 29, slide 30 extends over the entire length of carriage guide 26.

One particular feature of the system shown in FIGS. 1–3 also consists in that prepared individual lines 2 and 3 are each mechanically moved using transfer carriage 7 of transfer means 8 from preparation machine 5 to the following twisting device, the individual lines lying on conveyor belt 9' which extends away from the side of preparation machine 5 facing away from storage spools 6 and the corresponding adjacent side of twisting device 10 and conveys in this direction, so that individual lines 2 and 3 when transferred from preparation machine 5 to twisting device 10 are held stretched on conveyor belt 9'.

With twisting device 10 the untwisted length of individual lines 2 and 3 on both ends of twisted line 1 can also be adjusted as desired by corresponding adjustment or programming of control means 16. The untwisted length on that side of twisted line 1 which is clamped for twisting on holding tongs 12 can be adjusted before pulling individual lines 2 and 3 through the eyes formed by counterpiece 23 and tong surfaces 22' of closed tongs 21*a*, by regrasping individual lines 2 and 3 one or more times with holding tongs 12, i.e. first using holding tongs 12 in the aforementioned manner the ends of individual lines 2 and 3 are grasped and then carriage 14 controlled by control means 16 is moved by a stipulated length (regrasping stroke) which corresponds roughly to the untwisted length away from tongs 21*a* so that individual lines 2 and 3 are drawn with this length through the eyes formed by tongs 21*a*.

Then holding tongs 12 are opened and carriage 14 is moved back to closed tongs 21*a*. Individual lines 2 and 3 which stand away from tongs 21*a* are grasped again by closing holding tongs 12. The free, untwisted length of individual lines 2 and 3 can be adjusted on their end held by holding tongs 12 by the size of this regrasping stroke. For larger untwisted lengths repeated regrasping is conceivable.

The free untwisted length of individual lines 2 and 3 on their end held on holding tongs 21*a* during twisting takes place in turn controlled by control means 16 by carriage 14 being moved before twisting away from tongs 21*a* and thus individual lines 2 and 3 are drawn through the eyes formed by counterpiece 23 and tong surfaces 22' only to such an extent that individual lines 2 and 3 stand away with the desired untwisted length above the side of holder 11 facing away from holding tongs 12.

FIG. 12 again shows a cross section through twisting device 10*a* which differs from twisting device 10 essentially only in that above trays 19 and 19*a* in addition to swivelling slide 30 which consists of a plurality of segments or which is made comb-like, there is a plurality of holding arms 32 in the direction of the horizontal longitudinal axis of twisting device 10*a* distributed at given intervals and on one end can be swivelled around this horizontal axis 33 on support 34 of frame 25 of twisting device 10*a*. All holding arms 32 extend radially away from axis 33 and can be swivelled around this axis in one vertical plane from a top position reproduced in FIG. 12 with solid lines, in which holding arms 32 form a tray for twisted, prepared lines 1, into a position in which these lines are transferred to underlying slide 30. Holding arm 32 is controlled such that it acts as an intermediate buffer, i.e., on holding arms 32 in the upper swivelling position first a number of twisted lines 1 preselected on control means 16 is deposited. When this number is reached, holding arms 32 are swivelled downward so that twisted lines 1 end up in tank 29. Then holding arms 32 are again swivelled upward in order to be able to deposit other twisted lines there.

FIG. 13 shows twisting device 10 together with capping or socket or plug housing mounting device 35 with which one plastic socket or plug sleeve 36 at a time is pushed onto two electrical connections 4 of line 1, specifically onto connections 4 which are located on those ends of individual lines 2 and 31; the ends during twisting are held by holding tongs 21*a*. For this capping (also block loading) there is a second transfer means 8*a* which corresponds to transfer carriage 8, specifically with transfer carriage 7*a*. With the latter the end of twisted line 1 held on holding tongs 21*a* is picked up by holding tongs 21*a* and moved to test station 37, where the presence of two connections 4 and their correct orientation are checked, and then to actual capping station 38 for application of common socket 36 to two connections 4. Line 1 provided with sleeve 36 is then moved further using transfer carriage 7*a* to the tray formed on the end of transfer means 8*a*.

The advantage of capping device 35 consists in that the ends of the individual lines or electrical couplings or contact elements 4 there are picked up by holding tongs 21*a* in a stipulated orientation and position to one another and this position and orientation are also maintained on transfer carriage 7*a* until release of line 1 provided with sleeve 36.

In the embodiment shown in FIG. 13, capping device 35 is an independent machine which is located to the side of twisting device 10. Basically it is also possible to perform capping in twisting device 10 with individual lines 2 and 3 clamped on holding tongs 21*a*. In this case capping station 38 on these holding tongs is in twisting device 10, then capping being possible before twisting, during twisting or even after twisting.

When using a capping station with a feeder it is also possible to apply a plug or socket housing to contacts 4 on the other end of lines 1 for example before twisting, for example, with individual lines 2 and 3 held on transfer carriage 7.

FIG. 14 shows one embodiment in which there are two twisting devices 10 in parallel which interact with preparation device 5. This embodiment is used especially when preparation of individual lines 2 and 3 can be done in a shorter time than twisting of these lines.

Instead of transfer means 8 there is transfer means 8*b* with transfer carriages 7*b* controlled by control means 16 which can approach a total of three positions, specifically the position on preparation device 5 for holding in individual lines 2 and 3 and one position each on holding tongs 21*a* of each twisting device 10. Loading of two twisting devices 10 with individual lines 2 and 3 takes place successively in time. Performance can be greatly increased by the tandem operation of two twisting devices 10.

The invention was described above on embodiments. It goes without saying that numerous modifications and alterations are possible without departing from the inventive idea underlying the invention.

We claim:

1. A device for producing twisted prepared electrical lines, with a carriage guide, for a carriage, provided on a device frame, having a first holder located on said carriage, a second holder provided in one end of said carriage guide on said device frame, a twisting segment disposed between said first holder and said second holder, said first holder being driven to rotate around an axis of said twisting segment by a drive, comprising:

control means for controlling said first and second holders, said drive and a carriage drive such that before a start of each twisting process, individual lines are tensioned so that an entire length of each of said individual lines is between said first holder and said second holder on said twisting segment and then said individual lines are twisted, while corresponding braking of said carriage to maintain a predetermined tension, by turning said first holder provided on said carriage.

2. A device as claimed in claim 1, wherein said first holder provided on said frame comprises first holding tongs.

3. A device as claimed in claim 1, further comprising transfer means for simultaneous transfer of at least two of said prepared individual lines from a preparation device to one of a twisting device and said second holder, said transfer means having at least second holding tongs movable in a transfer movement between first position on said preparation device and at least one second position where said second holding tongs lie adjacent said first holding tongs.

4. A device as claimed in claim 3, wherein second holding tongs can be moved for one stroke transversely to said transfer movement.

5. A device as claimed in claim 1, further comprising a capping station for pushing one of a housing and a socket onto ends of said individual lines, said individual lines being held preferably in one said second holder and are provided with electrical contacts.

6. A device as claimed in claim 5, wherein said capping station is provided on said device for producing a twisted pair.

7. A device as claimed in claim 5, wherein said capping station is a component of a capping device, and wherein a transfer means is provided between said twisting device and said capping station, wherein said individual lines with ends to be capped are moved from said twisting device to said capping station.

8. A device as claimed in claim 1, wherein two of said twisting devices are provided for one preparation device, and wherein between said preparation device and said two twisting devices is disposed a transfer means for feeding said prepared individual lines to said two twisting devices.

9. A device as claimed in claim 1, further comprising an intermediate tray for holding said twisted segment, wherein said intermediate tray can be opened under control of control means.

* * * * *